US007954672B2

(12) United States Patent
Keller

(10) Patent No.: US 7,954,672 B2
(45) Date of Patent: Jun. 7, 2011

(54) DISPENSING APPLIANCE FOR A DOUBLE SYRINGE

(75) Inventor: Wilhelm A. Keller, Merlischachen (CH)

(73) Assignee: Sulzer Mixpac AG, Rotkreuz (CH)

( * ) Notice: Subject to any disclaimer, the term of this patent is extended or adjusted under 35 U.S.C. 154(b) by 392 days.

(21) Appl. No.: 12/223,368

(22) PCT Filed: Feb. 13, 2007

(86) PCT No.: PCT/CH2007/000071
§ 371 (c)(1),
(2), (4) Date: Jul. 28, 2008

(87) PCT Pub. No.: WO2007/095769
PCT Pub. Date: Aug. 30, 2007

(65) Prior Publication Data

US 2009/0020561 A1 Jan. 22, 2009

(30) Foreign Application Priority Data

Feb. 24, 2006 (CH) ..... 0288/06

(51) Int. Cl.
*B67D 7/70* (2010.01)

(52) U.S. Cl. ..... 222/137; 604/191

(58) Field of Classification Search ..... 222/137, 222/127, 142, 145.1, 131–134, 325, 327; 604/82, 191
See application file for complete search history.

(56) References Cited

U.S. PATENT DOCUMENTS

| | | | | |
|---|---|---|---|---|
| 4,424,817 | A * | 1/1984 | Williams | 600/579 |
| 4,874,368 | A | 10/1989 | Miller et al. | |
| 5,005,735 | A | 4/1991 | Keller | |
| 5,181,912 | A * | 1/1993 | Hammett | 604/110 |
| 6,047,861 | A * | 4/2000 | Vidal et al. | 222/137 |
| 6,454,739 | B1 * | 9/2002 | Chang | 604/82 |
| 6,585,696 | B2 * | 7/2003 | Petersen et al. | 604/191 |
| 7,537,174 | B2 * | 5/2009 | Redl et al. | 239/321 |

FOREIGN PATENT DOCUMENTS

| | | |
|---|---|---|
| DE | 19 38 028 A1 | 1/1971 |
| EP | 0 037 393 A1 | 10/1981 |
| EP | 0 315 222 A2 | 5/1989 |
| EP | 0 791 403 A1 | 8/1997 |
| WO | WO 94/07420 A1 | 4/1994 |

* cited by examiner

*Primary Examiner* — Lien T Ngo
(74) *Attorney, Agent, or Firm* — Kilpatrick Townsend & Stockton LLP

(57) ABSTRACT

The dispensing appliance for a double syringe includes double plungers (4) connected by a thrust plate (5) and a flange holder (6) having a guiding slot (8) for receiving the retaining flange (9) of the double syringe (1) and at least one finger rest grip (7). Such a dispensing appliance allows an easier dispensing especially of smaller double syringes.

5 Claims, 3 Drawing Sheets

FIG. 1
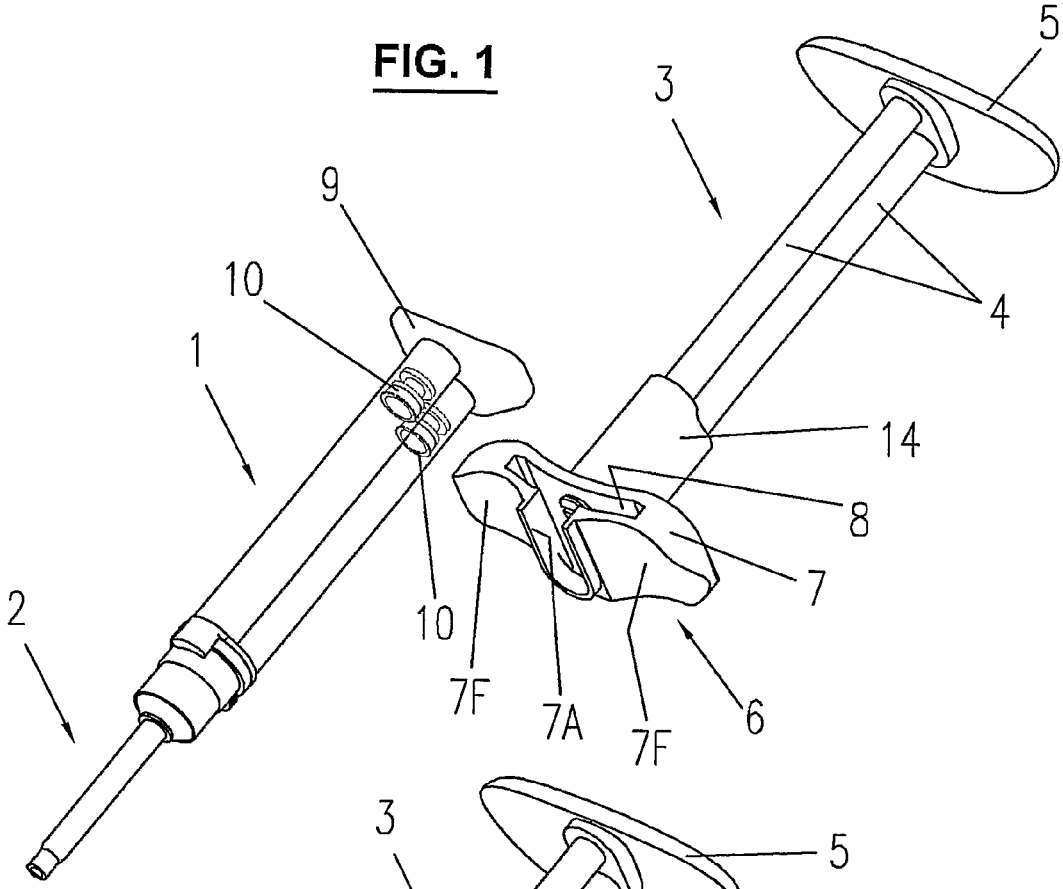
FIG. 2
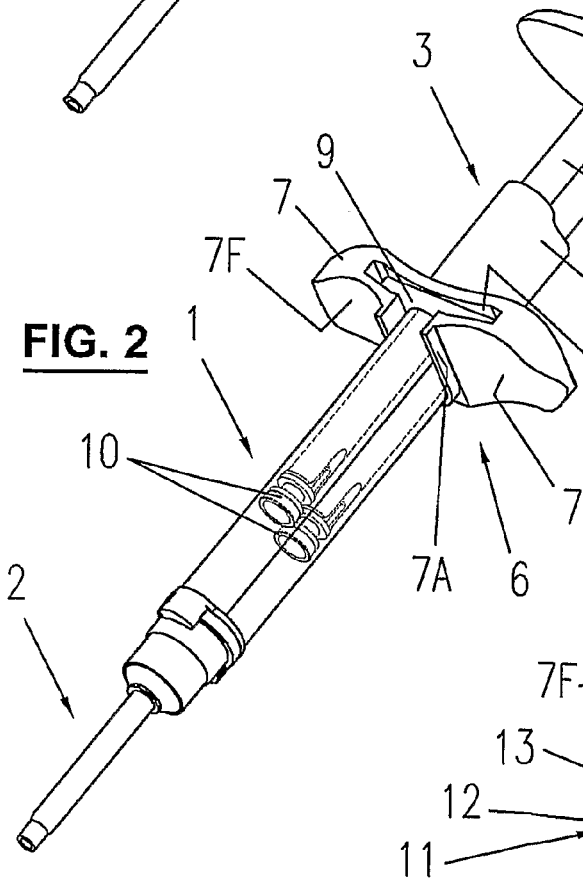
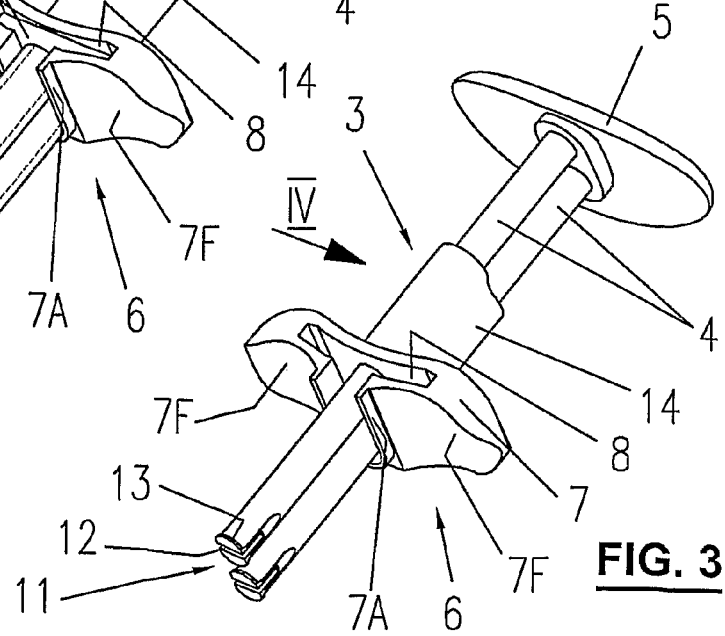
FIG. 3

DISPENSING APPLIANCE FOR A DOUBLE SYRINGE

CROSS-REFERENCES TO RELATED APPLICATIONS

This application is a National Stage of International Application No. PCT/CH2007/000071, filed Feb. 13, 2007, and which claims the benefit of Swiss Patent Application No. 288/06, filed Feb. 24, 2006, the disclosures of which applications are incorporated herein by reference.

BACKGROUND OF THE INVENTION

Generally, double syringes or double cartridges with a static mixer are used for mixing and dispensing two-component materials. A double syringe system generally consists of two parallelly arranged storage cylinders, two pistons, a common closure, and a double plunger. To dispense the content, the pistons are pushed forward by means of the double plunger.

Particularly in smaller double syringes for single use, the conventional dispensing by means of the dual plungers may result in handling problems because of the small dimensions. It would therefore be desirable to provide a dispensing appliance that allows comfortable dispensing also of small double syringes.

EP-A2-0 315 222 discloses a dispensing device in which two syringes are held together at the device's outlet end by a connecting part with a common outlet, and at the inlet end by a bridge connecting the two plungers. This device does not solve the problem of small syringes, which is not addressed therein.

SUMMARY OF THE INVENTION

Embodiments described herein provide a dispensing apparatus for a double syringe or double cartridge. The apparatus includes two plungers connected by a thrust plate, and a flange holder. The flange holder includes a guiding slot for receiving a retaining flange of the double syringe or double cartridge, at least one finger rest grip, and an elongate plunger guide extending from a side of the flange holder that faces away from the double syringe or double cartridge.

In some embodiments, an end of each of the plungers, which opens out elastically, has an incision and a circumferential bulge.

In some embodiments, the flange holder has two finger rest grips. The second finger rest grip is provided between the first finger rest grip and the thrust plate. In some embodiments, the second finger rest grip is provided on the plunger guide.

In some embodiments, the guiding slot in the flange holder has a coded internal contour for receiving a coded contour of the retaining flange of the double syringe or double cartridge in an unequivocal position.

The invention will be explained in more detail hereinafter with reference to drawings of exemplary embodiments.

BRIEF DESCRIPTION OF THE DRAWINGS

FIG. 1 shows a perspective view of a double syringe with a mixer and of a dispensing appliance according to embodiments of the invention, FIG. 2 shows the double syringe of FIG. 1 inserted in the dispensing appliance of FIG. 1, FIG. 3 shows the dispensing appliance of FIG. 2.

DESCRIPTION OF THE PREFERRED EMBODIMENTS

Figure 4:
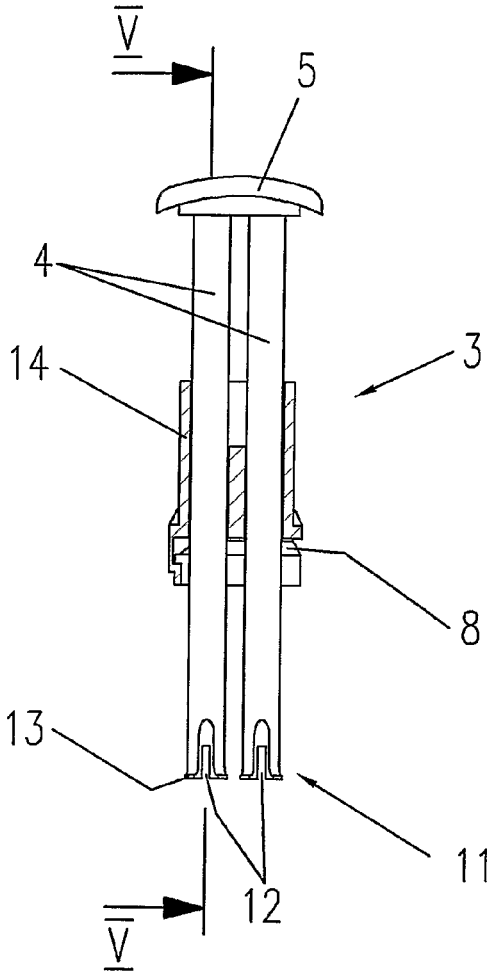
FIG. 4 shows a partly sectioned view according to arrow IV in FIG. 3.

FIG. 1 shows double syringe 1 with a mixer 2 as well as a first embodiment of the dispensing appliance 3 of the invention with double plunger 4, connected by thrust plate 5, as well as a flange holder 6 having a finger rest grip 7 with finger rests 7F and a guiding slot 8 for receiving retaining flange 9 of double syringe 1. On the syringe side of the flange holder, a collar 7A is provided that serves for guiding the syringe and comprises a syringe snap-in retainer for the container that is inserted first (which is, in the case of container volumes that are different from 1:1, the larger container). Furthermore, in FIG. 1, pistons 10 in the syringe are shown.

FIG. 1 shows how the filled and operational syringe 1 can be introduced with its retaining flange 9 into guiding slot 8 of the flange holder of the dispensing appliance. The internal contour of guiding slot 8 is adapted to the coded external contour of retaining flange 9, thereby precluding non-system syringes from being used and ensuring, in syringes having containers whose volumetric ratio (and thus diameter ratio) is different from 1:1, that the syringe is inserted into the guiding slot in the correct position.

In FIG. 2, the syringe is in place on the dispensing appliance and a part of the content of the double syringe has already been dispensed, as follows from the position of the pistons and plungers.

Figure 6:
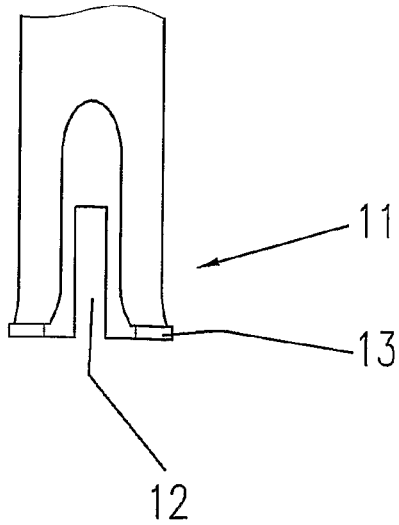
FIG. 6 shows an enlarged detail of the plunger end according to FIG. 4.

In FIG. 3 it is apparent that the forward ends 11 of double plungers 4 have an incision 12 to provide a certain elasticity of these ends. In the enlarged illustration of FIG. 6 of a plunger end it is visible that the end spreads out slightly resiliently and has a circumferential bulge 13 such that the plunger ends have a slightly larger diameter than the remainder of the plungers. This enlargement of the circumference by the circumferential bulge 13 and the slight spreading at ends 11 of double plungers 4 have the effect that when the double plunger is pulled back, it is first held back and can only be withdrawn from plunger guide 14 by applying an increased force. When a normal force is applied, the circumferential bulge provides sufficient safety against a complete withdrawal of the plunger from the flange holder.

In FIG. 4 it is shown that the double plungers are guided by a sufficiently long plunger guide 14 that is arranged on the finger rest grip and extends toward the thrust plate. This allows a precise application, which is important especially in smaller double syringes.

Figure 5:
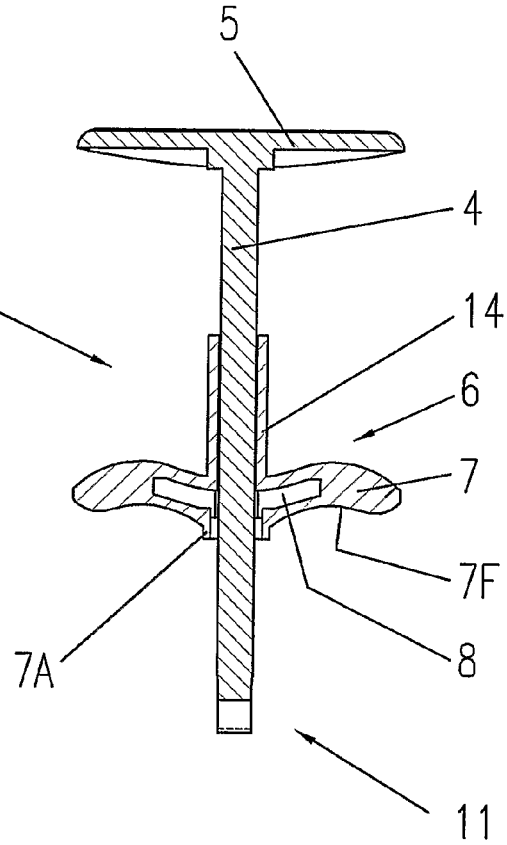
FIG. 5 shows a section according to line V-V in FIG. 4.

FIG. 5 illustrates flange holder 6 with finger rest grip 7 and its finger rests 7A as well as guiding slot 8, the latter guiding slot being shaped for receiving the coded and curved retaining flange of the double syringe.

Figure 7:
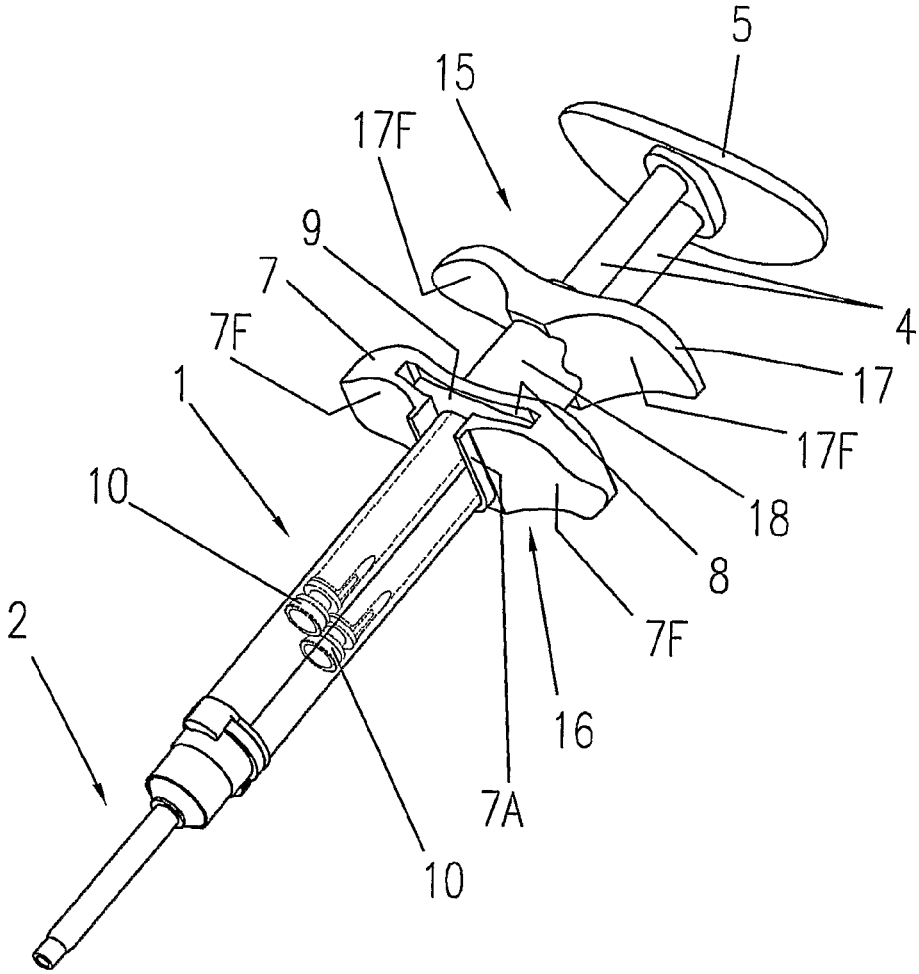
FIG. 7 shows a double syringe in an embodiment variant of a dispensing appliance.
Figure 8:
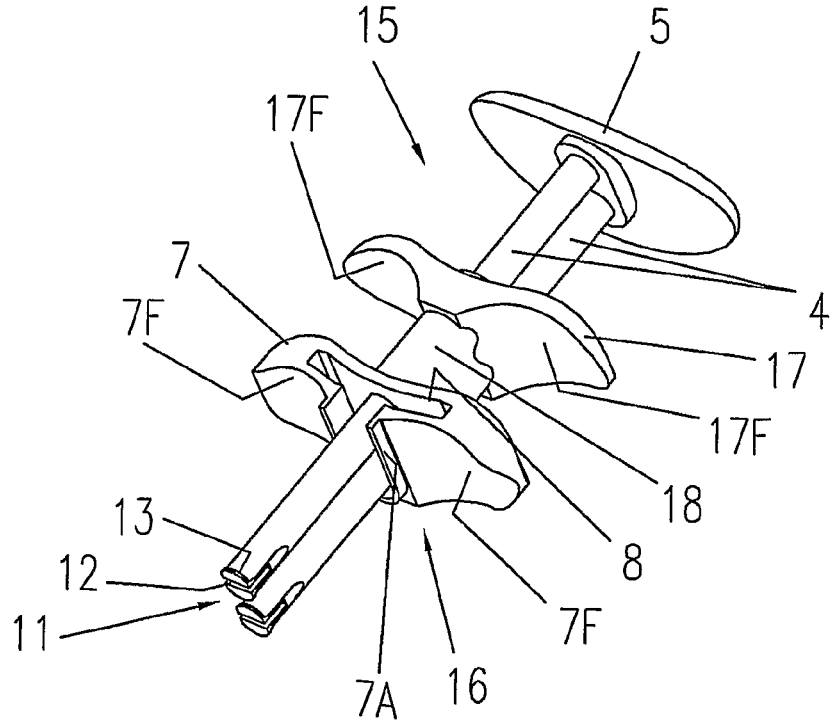
FIG. 8 shows the dispensing appliance of FIG. 7 in a perspective view and individually.

FIGS. 7 and 8 illustrate an embodiment variant where flange holder 16 of dispensing appliance 15 has a second finger rest grip 17 with finger rests 17F that is arranged on plunger guide 18 at some distance from the first finger rest grip 7. By this second finger rest grip, the distance to the thrust plate is reduced, thereby allowing a comfortable operation of the syringe also by people having smaller hands, especially in the case of longer syringes. The remaining parts of the dispensing appliance are the same as in the preceding exemplary embodiment.

The term "double syringe" is also meant to include a double cartridge. Moreover, instead of a mixer, any other accessory such as a spray nozzle or another accessory part may be connected to the double syringe.

The invention claimed is:

1. A dispensing apparatus for a double syringe or double cartridge, comprising:

two plungers connected by a thrust plate; and a flange holder, comprising:

a guiding slot for receiving a retaining flange of the double syringe or double cartridge;

at least one finger rest grip; and an elongate plunger guide extending from a side of the flange holder that faces away from the double syringe or double cartridge.

2. The dispensing apparatus according to claim 1, wherein an end of each of the plungers, which opens out elastically, comprises an incision and a circumferential bulge.

3. The dispensing apparatus according to claim 1, wherein the at least one finger rest grip comprises a first and a second finger rest grip, wherein the second finger rest grip is disposed between the first finger rest grip and the thrust plate.

4. The dispensing apparatus according to claim 3, wherein the second finger rest grip is disposed on the plunger guide.

5. The dispensing apparatus according to claim 1, wherein the guiding slot in the flange holder comprises a coded internal contour for receiving a coded contour of the retaining flange of the double syringe or double cartridge in an unequivocal position.

* * * * *